US005403158A

United States Patent [19]

Auxier

[11] Patent Number: 5,403,158

[45] Date of Patent: Apr. 4, 1995

[54] AERODYNAMIC TIP SEALING FOR ROTOR BLADES

[75] Inventor: Thomas A. Auxier, Palm Beach Gardens, Fla.

[73] Assignee: United Technologies Corporation, Hartford, Conn.

[21] Appl. No.: 173,531

[22] Filed: Dec. 23, 1993

[51] Int. Cl.[6] ..... F01D 5/18

[52] U.S. Cl. ..... 416/97 R; 415/173.1

[58] Field of Search ..... 415/115, 116, 173.1, 415/173.4; 416/90 R, 91, 92, 97 R, 97 A

[56] References Cited

U.S. PATENT DOCUMENTS

| | | | |
|---|---|---|---|
| 3,389,889 | 6/1968 | Penny | 416/92 |
| 4,390,320 | 6/1983 | Eiswerth | 416/97 R |
| 4,863,348 | 9/1989 | Weinhold | 416/92 |
| 5,282,721 | 2/1994 | Kildea | 416/97 R |

*Primary Examiner*—Edward K. Look
*Assistant Examiner*—Christopher Verdier
*Attorney, Agent, or Firm*—Norman Friedland

[57] ABSTRACT

Passive clearance control is attained for rotor blades for gas turbine engines in environments where the airfoil of the rotor is solid or where coolant is unavailable or is available but not at sufficient quantity to provide passive clearance control. In this situation a judiciously located curved slot extending from the tip of the blade adjacent the pressure side and terminating at the pressure side at a location where there is sufficient static pressure so that the pressure drop across the slot induces a pumping action. In embodiments where there is sufficient coolant for tip cooling, the curved slot is judiciously located to be in communication with the film cooling hole discharging on the pressure side of the blade and the tip of the blade adjacent the pressure side of the blade.

11 Claims, 3 Drawing Sheets

AERODYNAMIC TIP SEALING FOR ROTOR BLADES

TECHNICAL FIELD

This invention relates to rotor blades for gas turbine engines and particularly to means for passively controlling the gap between the rotor blades and the outer air seal.

BACKGROUND ART

As is well known in the aeronautical field, the efficiency of the rotor blades and particularly the turbine blades of a gas turbine engine is adversely affected by the leakage of the engine's working medium between the tips of the rotor blades and the outer air seal or shroud surrounding the tips. Obviously the portion of working medium that leaks, which portion would otherwise pass through the working blades, is wasted energy resulting in the degradation in performance of that rotor stage and hence, the performance of the engine. Over the years there have been numerous attempts to reduce the size of the gap between the tips of the rotor blades and the outer shroud or outer air seal either by active clearance control or passive clearance control in order to enhance performance of the engine.

Active clearance control includes an external control mechanism (open or closed loop) that effectively reduces the gap by controlling a medium that either heats or cools the component parts of the rotor assembly to either shrink or expand the case or the rotor disk or blades so as to move the rotating and stationary components toward or away from each other. Obviously, the control must avoid the pinch point where that the parts that expand at rapid different rates interfere with each other in order to avoid rubs which may cause damage to the engine. An example of an active clearance control is disclosed and claimed in U.S. Pat. No. 4,069,662 granted to I. H. Redinger, Jr. et al on Jan. 24, 1978 entitled "Clearance Control for Gas Turbine Engine" assigned to United Technologies Corporation, the assignee common to this patent application.

Passive clearance control, which is the subject matter of the present invention, utilizes the available working or cooling medium in the engine and without any control mechanism, effectively reduces the effective gap between the tips of the blade and the outer air seal. Examples of passive clearance controls are disclosed in U.S. Pat. No. 4,390,320 granted to J. E. Eiswerth on Jun. 28, 1983 entitled "Tip Cap for a Rotor Blade and Method of Replacement" and U.S. Pat. No. 4,863,348 granted to W. P. Weinhold on Sep. 5, 1989 entitled "Blade, Especially a Rotor Blade". Each of these patents disclose means for aerodynamically reducing the effective gap by injecting cooling air discharging from internally of the blade to a location that will effectively create a buffer zone to prevent the gas path from leaking and hence, bypassing the working area of the blade.

As mentioned in the above paragraph, the present invention is concerned with passive clearance control by aerodynamically reducing the effective gap between the tips of the rotating blades and the adjacent static structure. To better appreciate the present invention one should contrast the present invention with the state-of-the-art passive clearance controls. (The patents alluded to in the above paragraph are examples of state-of-the-art designs). As noted, there is a certain clearance that exists between the tips of the rotor blades and the static structure. As will be appreciated the aerodynamics of the blade inherently sets a static pressure differential across the blade tip that allows the leakage of the mainstream gas to bypass the blade's working area and flow through the gap. This tip leakage is the largest single source of energy loss in the rotor stage and the engine. As is well known, in certain cases, the clearance is set by transient conditions or mechanical constraints and hence, the designer has to live with the clearances and accept the penalty resulting thereby.

In heretofore known designs, it has been shown that coolant air ejected from internally of the blade toward the blade's pressure side creates a buffer zone so as to decrease the effective gap even though the physical clearance remains the same. This passive clearance control, obviously, increases the efficiency of that rotor stage. While this design works well for first turbine blades (the turbine mounted Just aft of the engine's combustor) that have a plentiful supply of internal cooling air, this design is inadequate or unavailable for rotors that either lack cooling air or haven't a sufficient amount. Thus, uncooled, unshrouded blades or blades that have small amounts of cooling air for root cooling but do not require tip cooling or require tip cooling but lack sufficient air for passive clearance control do not fall in the same category.

To this end this invention contemplates incorporating curved holes or slots located adjacent the tip and pressure side of the blade that serve to provide means for aerodynamically reducing the effective gap between the tip of the blades and the adjacent surrounding part.

While this invention is particularly efficacious for blades that have no or insufficient supply of cooling air, it also has application where there is an adequate supply of cooling air for tip cooling. In this environment this invention can be utilized to enhance tip sealing. In this later application where the airfoil requires tip cooling, film holes can be added to line up with the curved slots of this invention such that film air is used to provide the tip blockage flow. The curved slots are designed to breakout at the lip of the radial film holes in the airfoil such that the flow through the curved hole is at the exit coolant temperature of the film hole flow. Also, the film holes are angled to flow across the lands of the curved slots and the curved slot flow lines up with the lands of the film hole for maximum edge cooling effectiveness. The flow out of the film hole is sized to provide sufficient film flow and sufficient curved slot flow. In the case of a heavy rub of the tip of the blade in which the curved slots might smear shut, the total cooling flow is unchanged but is now 100% on the pressure side for better pressure side film which moderates the effect of the heavy rub and smearing on blade tip to enhance durability.

SUMMARY OF THE INVENTION

An object of this invention is to provide improved passive tip clearance control for the blades of rotors for gas turbine engines.

A feature of this invention is to provide for a passive tip clearance control a curved hole or slot extending from the pressure side of the airfoil inwardly toward the longitudinal axis of the blade and curving to meet the tip of the blade adjacent the pressure side.

Another feature of this invention is the utilization of the curved C-shaped slot as described on airfoils that lack internal cooling air or the internal cooling is limited to the root of the blade. It is also contemplated that the curved slot can be integrated with airfoils that include tip cooling by interconnecting the curved slot at some point intermediate the inlet and outlet of the film hole and extending the slot to the tip of the blade adjacent the pressure side, The foregoing and other features of the present invention will become more apparent from the following description and accompanying drawings,

DETAILED DESCRIPTION OF THE PREFERRED EMBODIMENT

Figure 2:
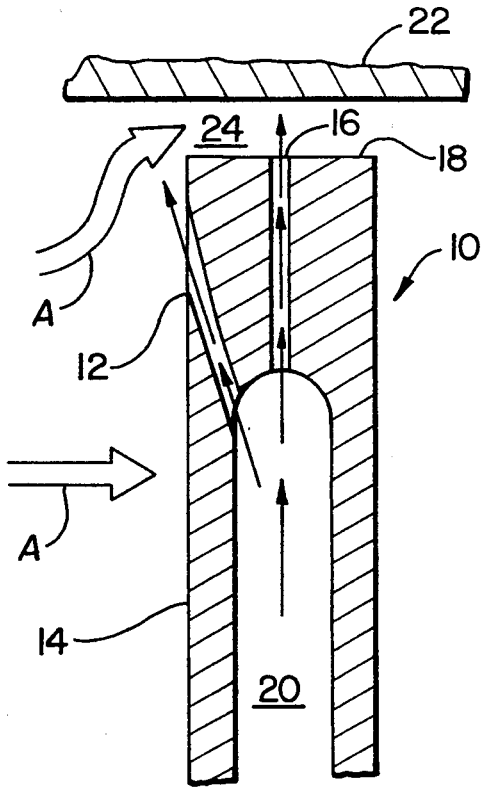
FIG. 2 PRIOR ART
FIG. 2 is a partial view in section of the prior art illustrating the cooling passages internal of a rotor blade.
Figure 3:
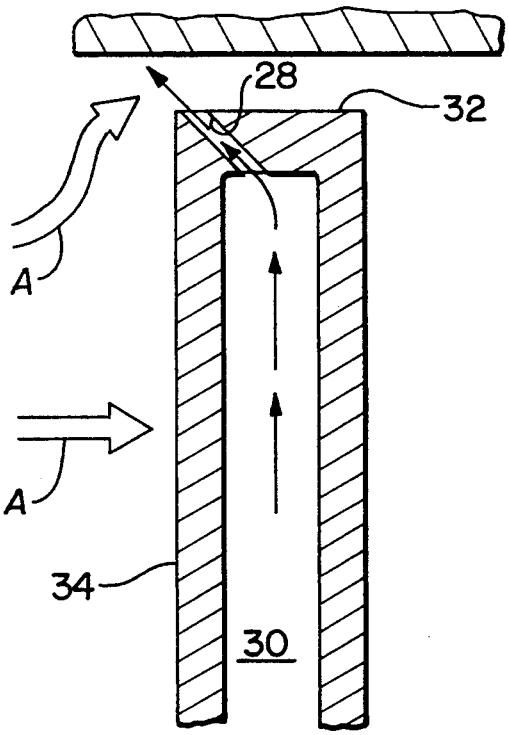
FIG. 3 PRIOR ART
FIG. 3 is a partial view in section the prior art illustrating the of cooling passages internal of a rotor blade for attaining passive clearance control.

An understanding of this invention can best be had by considering the state-of-the art turbine rotor blades intended for use in gas turbine engines. As noted in FIG. 2, which is a partial sectional view of a gas turbine engine axial flow turbine blade generally indicated by reference numeral 10 taken through the longitudinal axis. A plurality of identical blades are circumferentially spaced around the turbine rotor in a well known manner. As noted, this blade includes the film cooling holes 12 (one being shown) spaced along the pressure surface 14 and the tip cooling holes 16 (one being shown) for the tip section 18 wherein each hole communicates with a coolant feed passageway 20 formed internally of the blade. The outer air seal or shroud 22 surrounds the plurality of blades and defines therewith the gap 24 which varies during transient and static engine operating conditions. The aerodynamics of the blade sets a static pressure differential across the blade tip that induces leakage of the mainstream engine gas flow generally indicated by arrow A through the effective gap 24 and as a consequence causes a drop in turbine stage aero efficiency. This loss in efficiency is reflected in the overall performance of the engine and hence is a condition that has been a challenge to the engine designer. Inasmuch as the gap 24 is set by transient conditions or mechanical constraints, unless extraordinary means such as passive clearance control are taken, the design must live with the aero penalty. One method of attaining reduced leakage is a passive clearance control that utilizes the coolant discharging from the blade. As noted in FIG. 3 the coolant is ejected toward the tip and the pressure surface. The blade in FIG. 3. is a partial view of another blade shown in section taken along the longitudinal axis. Here the coolant is ejected through hole 28 communicating with internal passage 30. As is apparent, the hole 28 is angled to discharge coolant adjacent the tip 32 and pressure surface 34. This essentially sets up a damming effect adjacent the entrance of gap 24 that serves as an obstacle for the engine's gas stream to enter the gap 24. This effectively decreases the effective gap even though the physical clearance stays the same and effectively increases the stage aero efficiency.

Using the cooling air flow to drop effective clearance works well for first stage turbine blades, however, uncooled, unshrouded blades or blades that have small amounts of cooling air for root cooling but do not require tip cooling do not have the cooling air available to provide the tip clearance blockage from cooling air for attaining passive clearance control. This invention serves to provide means for attaining passive clearance control when the conditions enumerated immediately above are not present.

Figure 1:
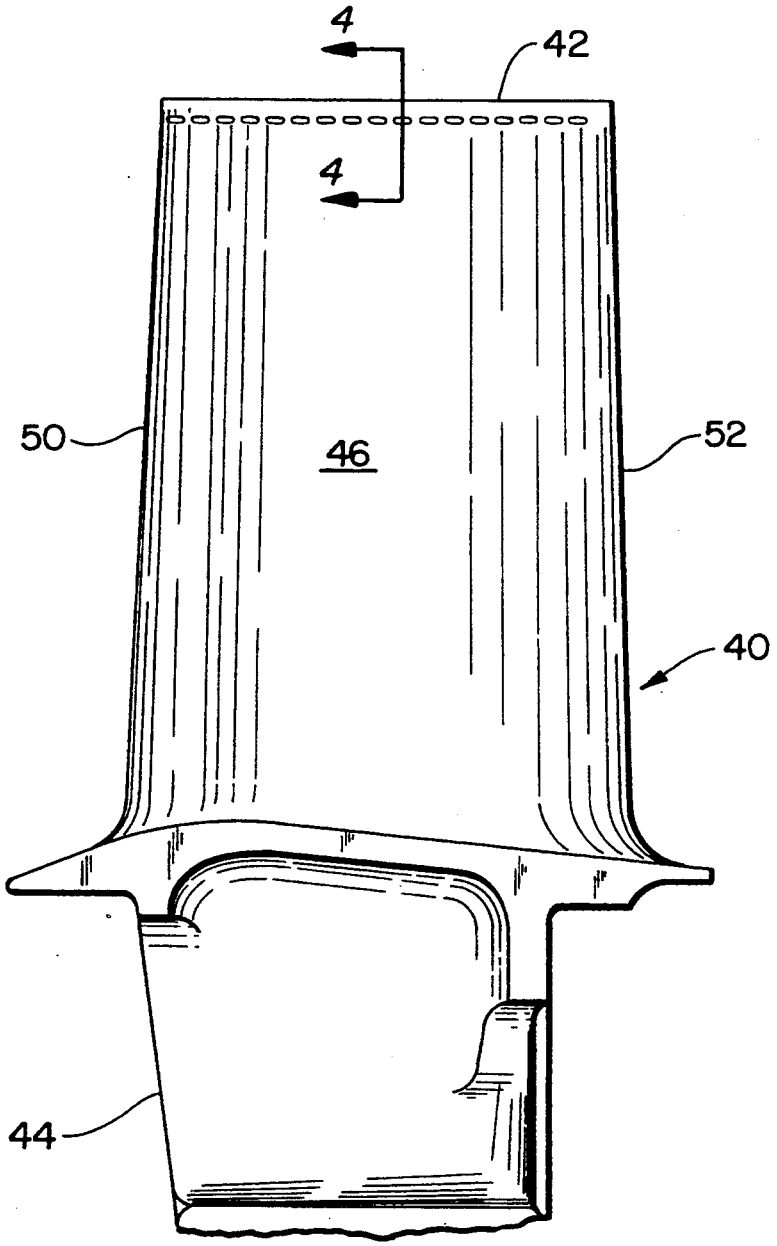
FIG. 1 is a view in elevation of a rotor blade for a gas turbine engine incorporating this invention.
Figure 4:
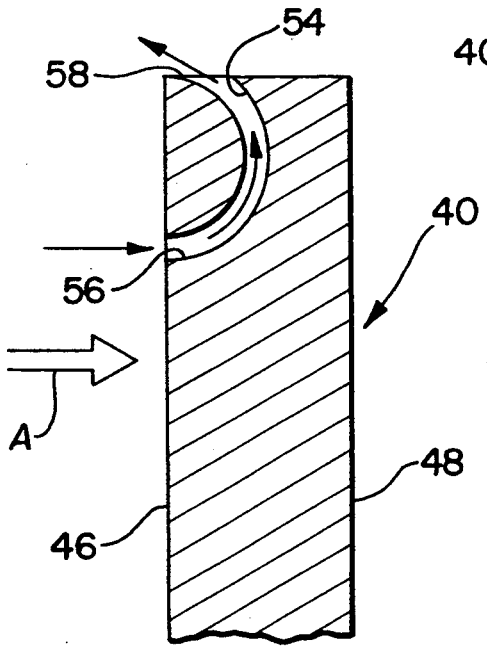
FIG. 4 is a partial view in section of a rotor blade taken along lines. 4—4 of FIG. 1 utilizing the present invention.
Figure 5:
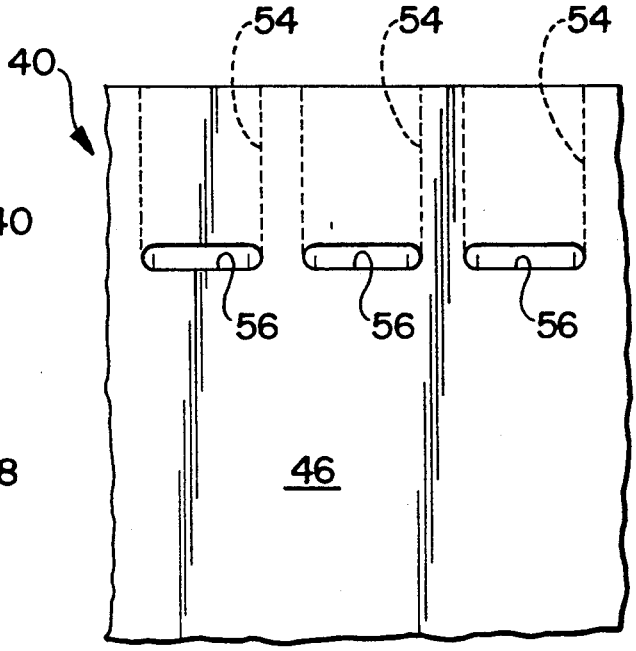
FIG. 5 is a partial side view of the embodiment exemplified in FIG. 4.

In accordance with this invention and as is described in connection with FIGS. 1, 4 and 5, I provide a C-shaped passage on the pressure side of the blade that provides the discharge orifice to be disposed adjacent the tip of the blade and oriented to inject the flow in a direction opposing the direction of the engine's main gas stream. As noted in FIG. 1 the blade generally indicated by reference numeral 40 which is a axial flow turbine blade consists of a tip section 42, root section 44, pressure surface 46, suction surface 48 (not seen in this Figure but is on the opposite face of the pressure surface), leading edge 50 and trailing edge 52. Blade 40 is solid and hence, does not include internal passages as would the blades in the first turbine stage. In a twin spool engine, for example, typically the blades of the low pressure turbine section are not internally cooled and typically are solid. As note in FIG. 4, to achieve passive clearance control the tip of the blade on the pressure surface includes a plurality of spaced rectangular C-shaped slots 54 extending from the leading edge 50 to the trailing edge 54 i.e. in a chordwise direction. The C-shaped slots in this embodiment are equally spaced. Specifically, each of the slots would be drilled from the tip 42 adjacent the pressure side and terminate on the pressure side radially downward relative thereto. Suitable drilling can be achieved by well know electro chemical milling process, laser beam drilling and the like. The inlet orifice 56 of the C-shaped slot 54 is judiciously disposed on the pressure surface and the outlet orifice 58 is judiciously disposed on the tip section 44 so that there is a sufficient pressure drop to induce pumping of the main gas stream gases through the slots 54. It has been demonstrated that the pressure adjacent the outlet orifice 58 is equal to suction side static pressure which is lower than the pressure side static pressure and at a sufficient level to induce a pumping action.

Figure 6:
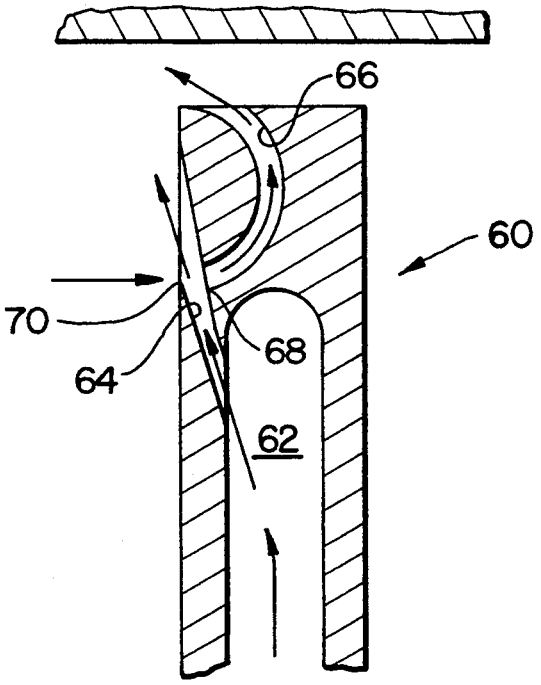
FIG. 6 is a partial view in section exemplifying another embodiment of this invention.
Figure 7:
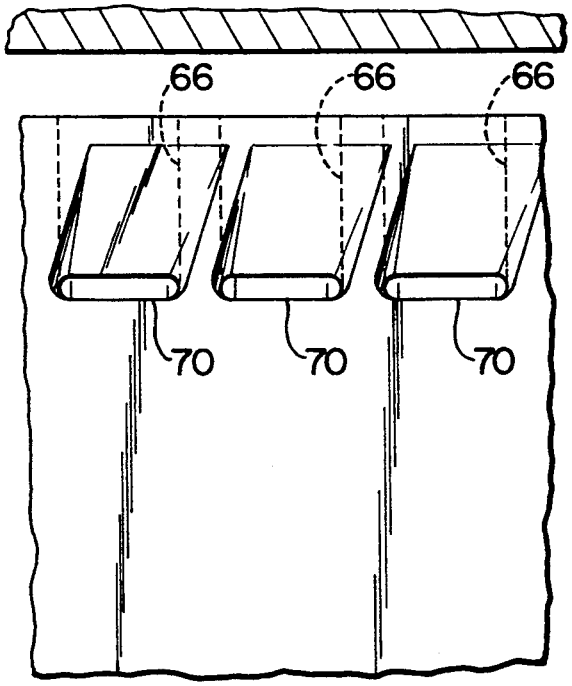
FIG. 7 is a partial side view of the embodiment of FIG. 6.

Also, in accordance with this invention the C-shaped slots can be utilized in internally air cooled turbine blades as exemplified in the embodiment disclosed in FIG. 6. As noted the partial sectional view of an internally cooled blade generally indicated by reference numeral 60, includes an internal longitudinal cooling passage 62 communicating with coolant from a suitable source, say the compressor section of the engine (not shown).

In the embodiment of FIG. 6, the airfoil requires tip cooling which is supplied coolant from the longitudinal passage 62. Radial film holes 64 intersects and communicates with the C-shaped slot 66 such that the coolant used for film cooling is also used for passive clearance control. The inlet 68 of C-shaped slot 66 is judiciously located to breakout at the lip 70 of the radial film hole 64. It is desirable to maintain the temperature of the flow through the C-shaped slot 64 at the same temperature as the temperature of the coolant at the exit of the film hole 64. The film holes 64 are angled to flow across the lands of the C-shaped slots 66 and the C-shaped slots flow lines up with the lands of the film holes 64 for maximum edge cooling effectiveness. To assure that there is adequate pumping action in the C-shaped slots 66, the flow out of the film hole 64 is sized to provide sufficient static pressure of the coolant flow utilized for film cooling in the film holes 64 and yet have sufficient flow for the C-shaped slots 66.

This invention also addresses the problem occasioned by a rub of the tips of the turbine blades against the outer shroud or casing. If the rub is sufficient to block the C-shaped slot 66 at the exit end the total coolant flow will remain unchanged. However, the entire flow will now be directed in the film hole and since this hole is on the pressure side of the airfoil it affords better film cooling effectiveness. This is exactly where it is desirable to attain better cooling in the event the C-shaped slot is blocked for the sake of durability.

What has been shown by this invention is means for achieving passive clearance control for attaining improved engine performance for airfoils that are not provided with internal cooling or in airfoils where there is internal coolant but lack sufficient coolant to provide the heretofore known passive clearance techniques.

Although this invention has been shown and described with respect to detailed embodiments thereof, it will be appreciated and understood by those skilled in the art that various changes in form and detail thereof may be made without departing from the spirit and scope of the claimed invention.

I claim:

1. For a gas turbine engine having a turbine rotor including a plurality of circumferentially spaced turbine blades, fluid working medium in said engine for powering said turbine rotor, said blades having a solid airfoil section, a pressure surface, a suction surface, a leading edge, a trailing edge, a root section and a tip section, said solid airfoil section being exposed to said fluid working medium and a portion of said working medium bypassing said airfoil and defining leakage flow, means for minimizing said leakage flow, said means including at least one passageway extending into the solid portion of said solid airfoil section from a point on the pressure side of the blade to a point adjacent to the tip section at the pressure side of said airfoil section, said one passageway being curved whereby a portion of said fluid working medium is conducted through said one passageway and discharged adjacent to said tip section in a direction opposing the flow stream of said fluid working medium to reduce said leakage flow and the pressure of the working medium adjacent said point adjacent to the tip on the pressure side being at a lower pressure than the pressure of said working medium adjacent to said tip section adjacent to said suction surface.

2. For a gas turbine engine as claimed in claim 1 wherein said curved passageway is C-shaped.

3. For a gas turbine engine as claimed in claim 2 wherein said blade includes a plurality of spaced C-shaped passageways.

4. For a gas turbine engine as claimed in claim 3 wherein said C-shaped passageways are rectangular in cross section.

5. For a gas turbine engine as claimed in claim 4 wherein said C-shaped passageways are equally spaced along the chordwise direction from said leading edge to said trailing edge.

6. For a gas turbine engine as claimed in claim 2 wherein each of said blades includes a C-shaped passageway.

7. For a gas turbine engine having a turbine rotor including a plurality of circumferentially spaced air cooled turbine blades, fluid working medium in said gas turbine engine for powering said turbine rotor, said air cooled turbine blades having an airfoil section, a pressure surface, a suction surface, a leading edge, a trailing edge, a root section and a tip section, internal passage means in said airfoil section for leading cooling air from said root section toward said tip section, an additional internal passage means interconnecting said internal passage means and discharge holes formed in said airfoil section, said airfoil section having a working surface subjected to the fluid working medium of the engine, a portion of said fluid working medium bypassing said working surface of said airfoil section and flow adjacent to said tip section, means for minimizing said portion of said fluid working medium from bypassing said working surface, said means including at least one passageway extending into said additional internal passage means from a point intersecting said additional internal passage means to a point adjacent to the tip section at the pressure side of said airfoil section, said one passageway being curved whereby a portion of the fluid in said internal passage is conducted through said curved passageway and discharged adjacent to said tip section in a direction opposing the flow stream of said fluid working medium to reduce the portion of said fluid working medium from bypassing said working surface.

8. A gas turbine engine as claimed in claim 7 wherein said one passageway is C-shaped.

9. For a gas turbine engine as claimed in claim 8 wherein said C-shaped passageway is rectangular in cross section.

10. For a gas turbine engine as claimed in claim 8 including a plurality of C-shaped passageways extending in a chordwise direction from the leading edge to the trailing edge.

11. For a gas turbine engine as claimed in claim 10 wherein said C-shaped passageways are equally spaced.

* * * * *

UNITED STATES PATENT AND TRADEMARK OFFICE

CERTIFICATE OF CORRECTION

PATENT NO. : 5,403,158

DATED : April 4, 1995

INVENTOR(S) : Thomas A. Auxier

It is certified that error appears in the above-identified patent and that said Letters Patent is hereby corrected as shown below:

Column 1, line 4, insert the following:

--This invention was made under a United States Government contract and the Government has rights herein.--

Signed and Sealed this

Fifteenth Day of August, 1995

Bruce Lehman

*Attest:*

BRUCE LEHMAN

*Attesting Officer*

*Commissioner of Patents and Trademarks*